US011906233B2

(12) United States Patent
Tollot et al.

(10) Patent No.: US 11,906,233 B2
(45) Date of Patent: Feb. 20, 2024

(54) DEFROST CONTROL METHOD IN A REFRIGERATION INSTALLATION AND ASSOCIATED CONTROL DEVICE

(71) Applicant: ELIWELL CONTROLS S.R.L. CON UNICO SOCIO, Alpago (IT)

(72) Inventors: Antonello Tollot, Alpago (IT); Carlo Tona, Alpago (IT); Devis Marcon, Colle Umberto (IT); Angelo Soccal, Belluno (IT); Vito Russo, Chioggia (IT)

(73) Assignee: ELIWELL CONTROLS S.R.L. CON UNICO SOCIO, Alpago (IT)

( * ) Notice: Subject to any disclaimer, the term of this patent is extended or adjusted under 35 U.S.C. 154(b) by 101 days.

(21) Appl. No.: 17/610,757

(22) PCT Filed: May 12, 2020

(86) PCT No.: PCT/IT2020/050115
§ 371 (c)(1),
(2) Date: Nov. 12, 2021

(87) PCT Pub. No.: WO2020/230178
PCT Pub. Date: Nov. 19, 2020

(65) Prior Publication Data

US 2022/0260301 A1 Aug. 18, 2022

(30) Foreign Application Priority Data

May 14, 2019 (IT) ..... 102019000006767

(51) Int. Cl.
*F25D 21/00* (2006.01)
*F25B 47/02* (2006.01)

(52) U.S. Cl.
CPC ..... *F25D 21/006* (2013.01); *F25B 47/02* (2013.01); *F25D 21/008* (2013.01);
(Continued)

(58) Field of Classification Search
CPC ..... F25D 21/006; F25D 21/008; F25D 2400/361; F25D 2600/02; F25D 2600/06;
(Continued)

(56) References Cited

U.S. PATENT DOCUMENTS

2004/0244389 A1 12/2004 Denvir
2008/0092569 A1 4/2008 Doberstein
2015/0184920 A1* 7/2015 Vie ..... F25D 21/008 62/155

OTHER PUBLICATIONS

International Search Report for corresponding application PCT/IT2020/050115 filed May 12, 2020; dated Sep. 11, 2021.
(Continued)

*Primary Examiner* — Nelson J Nieves
*Assistant Examiner* — Matthew John Moscola
(74) *Attorney, Agent, or Firm* — CANTOR COLBURN LLP

(57) ABSTRACT

A method to manage defrosting of a refrigeration plant provided with at least one compressor and at least one evaporator, including defining a plurality of defrosting modes, which can be selected by the manufacturer and/or by the end user, which are based on one or more functioning parameters of the refrigeration plant; such functioning parameters are detected by detection probes provided in the refrigeration plant such as pressure switches, thermostats, timing devices or other, associated with the compressor and/or the evaporator, or other; and memorizing the plurality of defrosting modes in an electronic device to manage the defrosting.

9 Claims, 3 Drawing Sheets

(52) U.S. Cl.
CPC .... *F25B 2347/02* (2013.01); *F25D 2400/361* (2013.01); *F25D 2600/02* (2013.01); *F25D 2600/06* (2013.01); *F25D 2700/10* (2013.01)

(58) Field of Classification Search
CPC ... F25D 2700/10; F25B 47/02; F25B 2347/02
See application file for complete search history.

(56) References Cited

OTHER PUBLICATIONS

Written Opinion for corresponding application PCT/IT2020/050115 filed May 12, 2020; dated Sep. 11, 2021.

* cited by examiner d0

| Parameter | Description | Range | Notes |
|---|---|---|---|
| d00 | Cumulative time for defrost activation | 0 - 250 | 0: mode disabled |
| d01 | Unit of measurement of parameter d00 | 0 - 2 | 0: hours<br>1: minutes<br>2: seconds |

d1

| Parameter | Description | Range | Notes |
|---|---|---|---|
| d10 | Apparatus time | 0 - 250 | 0: mode disabled |
| d11 | Unit of measurement of parameter d10 | 0 - 2 | 0: hours<br>1: minutes<br>2: seconds |

d2

| Parameter | Description | Range | Notes |
|---|---|---|---|
| d20 | Defrost enabling upon compressor stoppage | 0 - 1 | 0: mode disabled<br>1: mode enabled |

fig. 4 d3

| Parameter | Description | Range | Notes |
|---|---|---|---|
| d30 | Time compressor ON | 0 - 250 | 0: mode disabled |
| d31 | Unit of measurement of parameter d30 | 0 - 2 | 0: hours<br>1: minutes<br>2: seconds |

fig. 5 d4

| Parameter | Description | Range | Notes |
|---|---|---|---|
| d40 | Probe selection | 0 - x | 0: mode disabled<br>1: PB1<br>....<br>x: PBx |
| d41 | Threshold for defrosting activation | -55.0 - 110.0 °C/°F | |
| d42 | Amount of time below threshold | 0 - 250 minutes | |
| d43 | Mode for counting amount of time below threshold | 0 - 3 | 0: count independent of compressor status<br>1: count with compressor ON (if compressor OFF, count re-started)<br>2: count independent of compressor status, suspended if above threshold<br>3: count with compressor ON, suspended if above threshold |
| d44 | Threshold management mode | 0 - 1 | 0: absolute<br>1: relative (offset, negative, with respect to the temperature of the probe, d40, at the end of the first thermostat control cycle) |

fig. 6 d5

| Parameter | Description | Range | Notes |
|---|---|---|---|
| d50 | Probe 1 selection | 0 - x | 0: mode disabled<br>1: PB1<br>....<br>x: PBx |
| d51 | Probe 2 selection | 0 - x | 0: no probe<br>1: PB1<br>....<br>x: PBx |
| d52 | Threshold for defrosting activation | 0.1 - 110.0 °C/°F | Temperature delta between probe d50 and probe d51, in absolute value |
| d53 | Amount of time above threshold | 0 - 250 minutes | |
| d54 | Mode for counting amount of time above threshold | 0 - 3 | 0: count independent of compressor status<br>1: count with compressor ON (if compressor OFF, count re-started)<br>2: count independent of compressor status<br>3: count with compressor ON |
| d55 | Threshold management mode | 0 - 1 | 0: absolute<br>1: relative (offset, negative, with respect to the temperature delta at the end of the first thermostat control cycle) |

fig. 7 d9

| Parameter | Description | Range | Notes |
|---|---|---|---|
| d90 | RTC defrost mode | 0 - 3 | 0: mode disabled<br>1: RTC with time periods<br>2: RTC with fixed intervals (dE91)<br>3: periodic RTC (d94) |
| d91 | Number of daily defrosts | 1 - 255 | |
| d92 | First public holiday | 0 - 7 | 0: Sunday<br>1: Monday<br>...<br>6: Saturday<br>7: Disabled |
| d93 | Second public holiday | 0 - 7 | |
| d94 | Duration of periodic defrost interval | 1 – 7 days | |

fig. 8

DEFROST CONTROL METHOD IN A REFRIGERATION INSTALLATION AND ASSOCIATED CONTROL DEVICE

TECHNICAL FIELD

The present disclosure concerns a method to manage the defrosting of a refrigeration plant.

Such method is applicable to a refrigeration plant used in any field, therefore in industrial refrigeration, commercial refrigeration, refrigerated transport, in the home, or other. The present disclosure also concerns an electronic device to manage the defrosting of a refrigeration plant suitable to apply the method as above.

BACKGROUND

It is known that refrigeration plants are normally used in the domestic, industrial and commercial sectors to store foodstuffs, beverages or suchlike, but also pharmaceutical products or other. Refrigeration plants can also be used on means of transport to temporarily store foodstuffs, beverages or suchlike.

It is known that deposits of frost or ice can periodically form in refrigeration plants, which tend to accumulate on the walls of the refrigeration plant, in particular in the zone where the evaporator is located, that is, the component on the surface of which the formation of frost or ice is most likely to occur.

The formation of frost can generate problems with the functioning of the plant and drops in its cooling yield or capacity, which normally decreases as the amount of frost present on the evaporator increases.

Furthermore, it can create problems of aesthetic imperfections in the case of refrigerators used for sale or display, as well as droplets or deposits of water, which are also not acceptable in public contexts.

For this reason, in a refrigeration plant, defrosting operations have to be planned periodically, which can be performed in different ways, depending on the type of plant and on the different operating needs of the refrigeration plant.

An automatic defrosting mode, for example, can provide to automatically start a resistance that heats the evaporator based on a series of parameters of the refrigeration plant. For example, it can be provided that the resistance is activated when the temperature of the evaporator drops below a certain threshold value, or when the compressor of the refrigeration plant stops, or also after a certain period of time during which the refrigeration plant has been functioning, or other.

Therefore, normally, in refrigeration plants there are probes, thermostats, pressure switches, timing devices that measure how long the refrigeration plant has been functioning, for example daily, or other instruments which can be used based on the defrosting methods employed.

The manufacturers of refrigeration plants, whether they are domestic, industrial, commercial, used for transport or others, or rather the manufacturers of the management and control systems of refrigeration plants, set in the control unit that governs the refrigeration plant one or more modes for carrying out defrosting cycles, based on the request of the end user.

Such modes can be based on parameters, such as the functioning hours of the compressor, the functioning hours of the refrigeration plant, the stoppage of the compressor, the excessive lowering of the temperature of the evaporator, or more.

It is known that such modes for selecting the defrosting cycles on the basis of determinate functioning parameters are preset by the manufacturers, by trying to predict in which situations it is assumed that the refrigeration plant will need a defrosting action or cycle.

In this way, the manufacturer or the end user do not have the possibility to choose specific and suitable defrosting modes based on parameters that reveal the functioning conditions of the refrigeration plant.

Such limited possibility of choosing the defrosting modes that can be activated can, in short, lead to problems with the functioning of the refrigeration plant, limited possibilities of managing the refrigeration plant, excessive energy consumption of the refrigeration plant and also a limited flexibility of use of the refrigeration plant, based precisely on the different or varied needs of the end user.

There is therefore the need to perfect a method and an electronic device to manage the defrosting of a refrigeration plant that can overcome at least one of the disadvantages of the state of the art.

US 2015/184920 describes a defrosting method and apparatus in which the defrosting mode can be based, alternatively and in a mutually exclusive manner, either on the functioning time of the compressor, or on the temperature of the heat exchanger.

In particular, one purpose of the present disclosure is to provide a method to manage the defrosting of a refrigeration plant that allows the manufacturer and/or the end user of the refrigeration plant to choose the most suitable defrosting modes, with possible setting of the corresponding parameters, in an independent manner which can be modified according to individual requirements.

Another purpose of the present disclosure is to provide a method to manage the defrosting of a refrigeration plant which substantially allows to use the refrigeration plant in an extremely flexible and effective manner, according to individual requirements and limiting its possible functioning problems, energy consumption and inefficiencies caused by the use of defrosting cycles that are pre-set and difficult to vary.

Another purpose of the present disclosure is therefore to perfect a method to manage the defrosting of a refrigeration plant that allows to manage the defrosting in a "modular" manner, that is, which can be activated according to the functioning modes chosen by the user.

Another purpose is to provide an efficient and practical electronic device to manage the defrosting of a refrigeration plant, configured to implement the management method as above.

The Applicant has devised, tested and embodied the present disclosure to overcome the shortcomings of the state of the art and to obtain these and other purposes and advantages.

BRIEF SUMMARY

The present disclosure is set forth and characterized in the independent claims. The dependent claims describe other characteristics of the disclosure or variants to the main inventive idea.

In accordance with the above purposes, the disclosure concerns a method to manage the defrosting of a refrigeration plant provided with at least one compressor and at least one evaporator, wherein the method comprises:

defining a plurality of defrosting modes, which can be selected by the manufacturer and/or by the end user in a non-exclusive manner, which are based on respective functioning parameters of the refrigeration plant; the functioning parameters are detected by means of detection probes provided in the refrigeration plant such as pressure switches, thermostats, timing devices or other, advantageously associated with the compressor and/or the evaporator, and/or other components of the plant;

memorizing the plurality of defrosting modes in an electronic device to manage the defrosting.

Advantageously, the present method to manage the defrosting of a refrigeration plant allows the manufacturer and/or the end user of the refrigeration plant to choose two or more defrosting modes that are not mutually exclusive, with possible setting of the corresponding parameters, in an independent manner which can be modified according to individual requirements.

By means of the present method to manage the defrosting, it is also possible to use the refrigeration plant in an extremely flexible and effective manner, according to individual requirements and limiting possible functioning problems, energy waste and more. The present method also advantageously allows to manage the defrosting in a "modular" manner, that is, to activate it according to two or more functioning modes chosen by the manufacturer and/or user.

According to another aspect of the disclosure, the functioning parameters of the refrigeration plant can be selected and adjusted by the user for each of the defrosting modes memorized in the electronic device.

The present method to manage the defrosting can, for example and also, comprise the selection of at least one defrosting mode based on the functioning time of the compressor of the refrigeration plant.

Alternatively, or in a desired combination, the present method can comprise the selection of at least one defrosting mode based on the functioning time of the refrigeration plant.

Alternatively, or in a desired combination, the present method can comprise the selection of at least one defrosting mode based on the detection of the stoppage of the compressor.

Alternatively, or in a desired combination, the present method can comprise the selection of at least one defrosting mode based on the functioning time that the compressor has remained always activated, that is, that the compressor has always been in "ON" mode.

Alternatively, or in a desired combination, the present method can comprise the selection of at least one defrosting mode based on the detection of the temperature of the evaporator below a certain set value.

Furthermore, the present method can comprise the selection of at least one defrosting mode based on a temperature range defined by the temperature difference detected by at least two probes in two distinct zones of the refrigeration plant.

The present method can also provide the selection of at least one defrosting mode based on time periods or time intervals set by the user.

The disclosure also concerns an electronic device to manage the defrosting of a refrigeration plant comprising at least one compressor and at least one evaporator. The electronic device, in some embodiments, comprises means to select a plurality of defrosting modes based on one or more functioning parameters of the refrigeration plant; such functioning parameters are detected by detection probes provided in the refrigeration plant, such as pressure switches, thermostats, timing devices or other, associated with the compressor and/or with the evaporator or other; the defrosting modes can be activated individually or in a modular manner.

The selection means, for example buttons, with which the present electronic device is provided advantageously allow to quickly and conveniently select two or more desired defrosting modes which are not mutually exclusive. Such selection means can be virtual buttons provided on a touch-screen display, or real buttons made on a box-shaped body of the electronic device.

BRIEF DESCRIPTION OF THE DRAWINGS

These and other aspects, characteristics and advantages of the present disclosure will become apparent from the following description of some embodiments, given as a non-restrictive example with reference to the attached drawings wherein:

FIG. 1 is a schematic view of an electronic device to manage the defrosting of a refrigeration plant according to the present disclosure;

FIGS. 2 to 8 are tables relating to defrosting modes that can be set individually or in a modulated form by the user, according to the present method to manage the defrosting.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION

Figures 1, 2, 3:
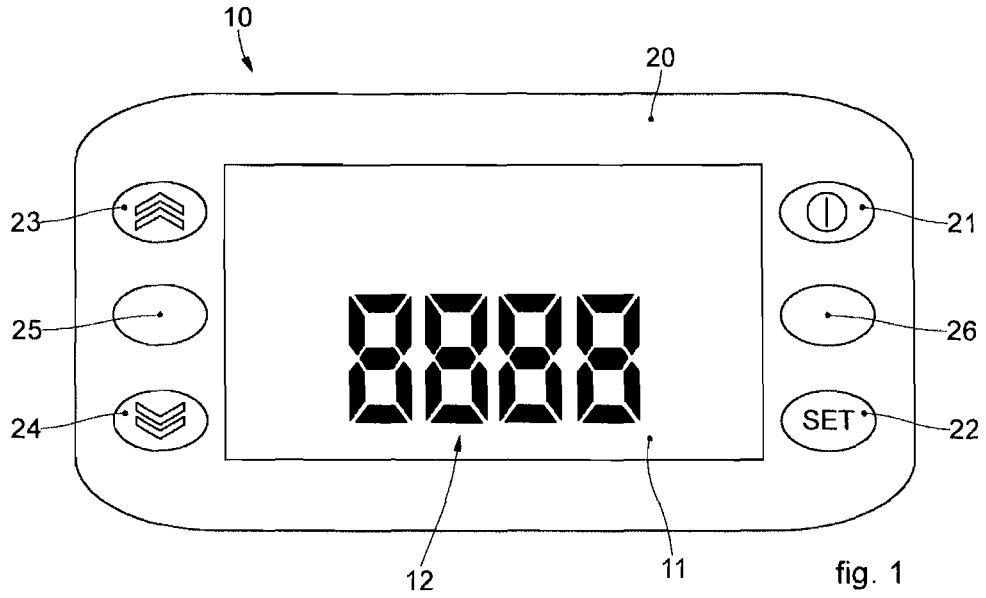

We will now refer in detail to the various embodiments of the present disclosure, of which one or more examples are shown in the attached drawings. Each example is supplied by way of illustration of the disclosure and shall not be understood as a limitation thereof. For example, the characteristics shown or described insomuch as they are part of one embodiment can be adopted on, or in association with, other embodiments to produce another embodiment. It is understood that the present disclosure shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

With reference to the attached drawings, FIG. 1 schematically shows an electronic device 10 according to the disclosure to manage the defrosting of a refrigeration plant provided with at least one compressor and at least one evaporator.

The electronic device 10 comprises a box-like body 20 and can be applied directly to a surface of the refrigeration plant in which it is used, advantageously in an easily accessible position, or it can also be installed in a remote position with respect to the refrigeration plant.

The electronic device 10 comprises a display 11 on which alphanumeric characters 12 can be displayed indicating the modes and functioning parameters of the refrigeration plant. Such display 11 can be for example of the touch-screen or liquid crystal type.

A series of menus will be shown on such display 11, relating to the various defrosting modes that can be started and chosen by the user by means of the electronic device 10.

The electronic device 10 also comprises a stand-by button 21 which can have a series of functions: by pressing and releasing this button 21 and assuming that the display 11 shows at that moment a determinate screen or a determinate menu of a certain defrosting mode, it is possible to go back one level from the current screen or menu; this button 21 can also be used to confirm the value of a determinate parameter set; by pressing it for a few seconds, for example 5 s, this button 21 allows to put the electronic device 10 on stand-by, for example.

The electronic device 10 also comprises a button 22, indicated as "Set", which also has a series of functions: by pressing and releasing this button 22 it is possible to display possible alarms (if any), access the status menu of the refrigeration plant and confirm the commands; by pressing it for a few seconds, for example 5 s, this button 22 allows to access the programming menu of the electronic device 10.

The electronic device 10 also comprises a button 23, which also has a series of functions: by pressing and releasing this button 23 it is possible to scroll through the items of a determinate menu of a selected defrosting mode, or increase the values of a determinate parameter; by pressing it for a few seconds, for example 5 s, this button 23 enables a manual defrosting function.

The electronic device 10 also comprises a button 24, which also has a series of functions: by pressing and releasing this button 24 it is possible to scroll through the items of a determinate menu of a certain defrosting mode, or decrease the values of a determinate parameter; by pressing it for a few seconds, for example 5 s, this button 24 enables functions which can be configured by a user.

The electronic device 10 could also comprise one or more additional buttons, for example a button 25, which pressed, for example for 5 s, can activate or enable functions which can be configured by a user.

The electronic device 10 could also comprise a button 26, which pressed for a few seconds, for example 5 s, enables functions which can be configured by a user.

The buttons with which the electronic device 10 is provided, therefore for example the buttons 21, 22, 23, 24, 25, and 26, can be made on the box-like body 20, as in FIG. 1, or they could be virtual commands or buttons provided on the display 11, or a combination of both solutions. In all cases these buttons 21, 22, 23, 24, 24 and 26 can be configured as means for selecting one or more of the defrosting modes.

Through the electronic device 10 the user can choose and enable two or more defrosting modes, not mutually exclusive, for example the defrosting modes d0, d1, d2, d3, d4, d5 and d9, for example by means of the buttons described above.

The electronic device 10 automatically checks whether the defrosting conditions of the enabled modes d0, d1, d2, d3, d4, d5 and d9 are met, that is, if the corresponding functioning parameters are satisfied, and, if at least one mode is satisfied, activates the defrosting according to that mode.

As we will see hereafter with the description of some examples of defrosting modes, the defrosting conditions refer to a series of functioning parameters, specific to each defrosting mode, and which can take determinate values, be comprised within determinate intervals, or other.

The user can in any case activate a defrosting by means of a button, which is called manual defrosting. For this purpose, one of the buttons described above, for example one of the buttons 25 or 26, can be associated with the start of a manual defrosting. In particular, in the present description we refer to seven defrosting modes d0, d1, d2, d3, d4, d5 and d9 which can be activated by the user individually or in combination with each other.

The first defrosting mode d0 can be, for example, a defrosting mode in which the defrosting is activated after a certain functioning time of the compressor of the refrigeration plant, see also FIG. 2.

Substantially, the parameter d00 concerns the cumulative time for the activation of the defrosting mode d0 and can be variable between 0 and 250, where the value "0" indicates the defrosting mode d0 is disabled. This parameter d00 can be already entered by the manufacturer at a predeterminate value, or it can be chosen by the user at a value comprised between 0 and 250. The parameter d01 concerns the unit of measurement of the parameter d00, therefore it can be for example hours, value "0", minutes, value "1", or seconds, value "2".

The second defrosting mode d1 can be, for example, a defrosting mode that is activated after a certain functioning time of the refrigeration plant, see also FIG. 3. Substantially, the parameter d10 concerns the functioning time of the refrigeration plant and can be variable between 0 and 250, where the value "0" indicates the defrosting mode d1 is disabled. The parameter d11 represents the unit of measurement of the parameter d00, therefore it can be for example hours, value "0", minutes, value "1", or seconds, value "2".

The third defrosting mode d2 can be, for example, a defrosting mode that is activated at each stoppage of the compressor of the refrigeration plant, see also FIG. 4. Substantially, the parameter d20 concerns the enabling of the defrosting mode d2 at each stoppage of the compressor, therefore it can have a value "0" which represents the defrosting mode d2 deactivated, or a value "1" which represents the defrosting mode d2 activated.

The fourth defrosting mode d3 can be, for example, a defrosting mode based on the amount of time the compressor is always on, that is, based on the compressor always being "ON", see FIG. 5. Substantially, the parameter d30 concerns the amount of time that the compressor is always on and can be variable between 0 and 250, where the value "0" indicates the defrosting mode d3 is disabled. The parameter d31 represents the unit of measurement of the parameter d30, therefore it can be for example hours, value "0", minutes, value "1", or seconds, value "2".

The fifth defrosting mode d4 can for example provide to detect the temperature of the evaporator by means of a specific probe PB1, PB2 . . . PBX and to activate it when the temperature of the evaporator drops below a certain set value, which means the presence of an excessive amount of frost or ice on the evaporator, see for example FIG. 6.

The parameter d40 concerns the possibility of choosing the probe PB1 . . . PBX to detect the temperature of the evaporator. The parameter d41 concerns the setting of the threshold for the activation of the defrosting, at a value comprised for example between −55° C. and 110° C. The parameter d42 allows to set the amount of time spent below the threshold, before the defrosting is activated, at a value comprised, for example, between 0 and 250 minutes. The parameter d43 concerns the mode for counting the amount of time spent below the threshold. This parameter d43 can have four values: a value "0" at which the count is independent of the state of the compressor of the refrigeration plant; a value "1" at which the count is performed with the compressor switched on (if the compressor is off the count is re-started); a value "2" at which the count is independent of the state of the compressor and is suspended above a certain threshold; a value "3" at which the count occurs with the compressor switched on and is suspended above a certain threshold. The parameter d44 concerns the mode for managing the threshold d41, that is, at a value "0" the threshold is considered as an absolute value and at a value "1" the threshold is considered as offset with respect to the value reached by the probe d40 at the end of the first thermostat control cycle that follows a defrosting cycle.

The sixth defrosting mode d5 can be based, for example, on a temperature range between at least two probes PB1 . . . PBX which are able to detect the temperature in at least two zones of the refrigeration plant. The parameter d50 concerns the selection of the first probe, while the parameter d51 concerns the selection of the second probe. The parameter d52 concerns the setting of the threshold for the activation of the defrosting, at a value comprised, for example, between 0.1° C. and 110° C., which is the difference, in absolute value, between the temperature value of the probe d51 minus the temperature value of the probe d52.

The parameter d53 concerns the amount of time spent above or below the threshold, and can be set at between 0 and 250 minutes.

The parameter d54 concerns the mode for counting the amount of time spent above the threshold. This parameter d54 can have, for example, four values: a value "0" at which the count is independent of the status of the compressor; a value "1" at which the count occurs with the compressor on (if the compressor switches off, the count is re-started); a value "2" at which the count is independent of the status of the compressor, which is suspended for values that are outside the threshold; a value "3" at which the count occurs with the compressor switched on, which is suspended for values that are outside the threshold or if the compressor switches off.

The parameter d55 concerns the mode for managing the threshold d42, that is, at a value "0" the threshold is considered as an absolute value and at a value "1" the threshold is considered as an offset with respect to the value taken by the difference, in absolute value, between the temperature of probe d51 minus the temperature taken by the probe d52, at the end of the first thermostat control cycle that follows a defrosting cycle.

The seventh defrosting mode d9 can concern the selection of at least one defrosting mode based on time periods or time intervals and set by the user. In this case, it is assumed that the refrigeration plant is equipped with a timing device or RTC (Real Time Clock).

The parameter d90 concerns the defrosting mode by means of RTC and can take different values from "0" to "x". For example, this parameter d90 can take the following values: a value "0" for a disabled mode; a value "1" in which the defrosting mode with RTC is in time periods; a value "2" in which the mode is at fixed intervals, see also the following parameter d91; a value "3" in which the mode with RTC is periodic, see also the following parameter d94.

The parameter d91 concerns the number of daily defrostings that can be set, when d90 is set to the value "2". This parameter d91 is variable, for example in a range from 1 to 255.

The parameter d92 concerns the possibility of setting the first public holiday, therefore it can take eight values from "0" to "7", where with "7" the mode is disabled while the values from "0" to "6" respectively concern the days of the week from Sunday to Saturday.

The parameter d93 concerns the possibility of setting the second public holiday, therefore it can take eight values from "0" to "7", where with "7" the mode is disabled while the values from "0" to "6" respectively concern the days of the week from Sunday to Saturday.

The parameter d94 concerns the setting of the duration of the interval of periodic defrosting and can vary from 1 to 7 days.

According to the present disclosure, a method to manage the defrosting of a refrigeration plant provided with at least one compressor and at least one evaporator comprises:

defining a plurality of defrosting modes, for example the defrosting modes d0, d1, d2, d3, d4, d5, d9 described previously, which are based on one or more functioning parameters of the refrigeration plant; such functioning parameters are detected by means of detection probes provided in the refrigeration plant such as pressure switches, thermostats, timing devices or other, associated with the compressor and/or the evaporator, or other;

memorizing the plurality of defrosting modes d0, d1, d2, d3, d4, d5, d9 in the electronic device 10 to manage the defrosting.

The present method to manage the defrosting therefore allows the user to select even two or more defrosting modes, not mutually exclusive, as a function of the requirements of the refrigeration plant.

In addition, the functioning parameters of the refrigeration plant can be chosen and adjusted by the user for each of the defrosting modes memorized in the electronic device.

It is clear that modifications and/or additions of parts and/or steps may be made to the method and electronic device to manage the defrosting as described heretofore, without departing from the field and scope of the present disclosure as defined in the claims.

It is also clear that, although the present disclosure has been described with reference to some specific examples, a person of skill in the art shall certainly be able to achieve many other equivalent forms of method and electronic device, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A method to manage defrosting of a refrigeration plant provided with at least one compressor and at least one evaporator, the method comprising:

defining a plurality of defrosting modes, which can be selected by the end user in a non-exclusive manner, which are based on one or more functioning parameters of the refrigeration plant, said functioning parameters being detected by means of detection probes provided in the refrigeration plant comprising at least one of pressure switches, thermostats, and timing devices associated with said compressor and/or said evaporator; and memorizing said plurality of defrosting modes in an electronic device to manage the defrosting, said electronic device being configured by the end user through means able to select said plurality of defrosting modes, in which the functioning parameters of the refrigeration plant are selected and adjustable by the end user for each of the defrosting modes memorized in the electronic device, such that said defrosting modes are activated individually or in a modular manner.

2. The method as in claim 1, further comprising the selection of at least one defrosting mode based on a functioning time of the compressor of the refrigeration plant.

3. The method as in claim 1, further comprising the selection of at least one defrosting mode based on a functioning time of the refrigeration plant.

4. The method as in claim 1, further comprising the selection of at least one defrosting mode based on detection of a stoppage of the compressor.

5. The method as in claim 1, further comprising the selection of at least one defrosting mode based on a functioning time during which the compressor has remained activated.

6. The method as in claim 1, further comprising the selection of at least one defrosting mode based on the detection of the temperature of the evaporator below a certain set value.

7. The method as in claim 1, further comprising the selection of at least one defrosting mode based on a temperature range defined by the temperature difference detected by at least two probes in two distinct zones of the refrigeration plant.

8. The method as in claim 1, further comprising the selection of at least one defrosting mode based on time periods or time intervals set by the user.

9. An electronic device to manage defrosting of a refrigeration plant comprising:

a compressor;

an evaporator; and means to configure the electronic device and to select a plurality of defrosting modes, which can be selected in a mutually non-exclusive manner by the end user, which are based on one or more functioning parameters of the refrigeration plant, said functioning parameters being detected by detection probes provided in the refrigeration plant comprising at least one of pressure switches, thermostats, and timing devices associated with said compressor and/or with said evaporator, said defrosting modes being activated individually or in a modular manner by the end user and the functioning parameters of the refrigeration plant being selected and adjustable by the end user for each of the defrosting modes memorized in the electronic device.

* * * * *